US008249291B2

(12) United States Patent
Hyde

(10) Patent No.: US 8,249,291 B2
(45) Date of Patent: Aug. 21, 2012

(54) EXTENDED MULTIPLE GAP MOTORS FOR ELECTROMAGNETIC TRANSDUCERS

(75) Inventor: Ralph E. Hyde, Santa Clarita, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1118 days.

(21) Appl. No.: 11/519,196

(22) Filed: Sep. 11, 2006

(65) Prior Publication Data

US 2007/0230737 A1 Oct. 4, 2007

Related U.S. Application Data

(60) Provisional application No. 60/787,054, filed on Mar. 28, 2006.

(51) Int. Cl.
*H04R 1/00* (2006.01)
*H04R 9/06* (2006.01)
*H04R 11/02* (2006.01)

(52) U.S. Cl. ..... 381/412; 381/401; 381/419; 381/420; 381/421

(58) Field of Classification Search ..... 381/412, 381/401, 419–421
See application file for complete search history.

(56) References Cited

U.S. PATENT DOCUMENTS

| | | | | |
|---|---|---|---|---|
| 4,783,824 | A * | 11/1988 | Kobayashi | 381/402 |
| 5,042,072 | A | 8/1991 | Button | |
| 5,748,760 | A | 5/1998 | Button | |
| 6,353,613 | B1 | 3/2002 | Kubota et al. | |
| 6,430,300 | B1 | 8/2002 | Cox et al. | |
| 6,671,385 | B2 * | 12/2003 | Suzuki et al. | 381/412 |
| 6,768,806 | B1 | 7/2004 | Button et al. | |
| 6,774,510 | B1 | 8/2004 | Moro et al. | |
| 6,847,726 | B2 | 1/2005 | Button et al. | |
| 6,868,165 | B1 | 3/2005 | Fabian | |
| 6,940,992 | B2 * | 9/2005 | Stiles | 381/412 |
| 7,012,345 | B2 | 3/2006 | Moro et al. | |
| 7,039,213 | B2 | 5/2006 | Hyre et al. | |
| 7,066,654 | B2 | 6/2006 | Wang et al. | |
| 7,227,970 | B2 * | 6/2007 | Calderwood et al. | 381/412 |
| 7,426,283 | B2 | 9/2008 | Kaiya et al. | |
| 7,574,013 | B2 | 8/2009 | Funahashi et al. | |
| 2001/0031063 | A1 | 10/2001 | Langford et al. | |
| 2004/0156527 | A1 * | 8/2004 | Stiles et al. | 381/412 |

* cited by examiner

*Primary Examiner* — Yuwen Pan
*Assistant Examiner* — Matthew Eason
(74) *Attorney, Agent, or Firm* — The Eclipse Group LLP

(57) ABSTRACT

An electromagnetic transducer includes an electromagnetic dual-coil or multi-coil driver having at least one spacer member placed between at least two permanent magnets. The inclusion of at least one spacer member increases the axial dimension of the magnetic assembly of the driver so that the magnetic gaps in a dual-coil or multi-coil driver are moved farther apart than would occur with a corresponding electromagnetic driver using a permanent magnet instead of two permanent magnets separated by a spacer member.

24 Claims, 11 Drawing Sheets

EXTENDED MULTIPLE GAP MOTORS FOR ELECTROMAGNETIC TRANSDUCERS

CROSS REFERENCE TO RELATED APPLICATIONS

This invention claims priority to U.S. Provisional Patent Application Ser. No. 60/787,054, filed on Mar. 28, 2006 and titled "Extended Multiple Gap Motors for Electromagnetic Transducers", the provisional application of which is incorporated in its entirety into this application.

BACKGROUND OF THE INVENTION

1. Field of the Invention

This invention relates generally to electromagnetic transducers of the type that may be employed as electro-acoustical drivers for loudspeakers. More particularly, the invention relates to electromagnetic transducers and loudspeakers adapted for extended motor excursion such as may be needed for high output or deep bass.

2. Related Art

An electro-acoustical transducer may be utilized as a loudspeaker or as a component in a loudspeaker system to transform electrical signals into acoustical signals. The basic designs and components of various types of electro-acoustical transducers are well-known and therefore need not be described in detail. An electro-acoustical transducer typically includes mechanical, electromechanical, and magnetic elements to effect the conversion of an electrical input into an acoustical output. For example, the transducer typically includes a magnetic assembly, a voice coil, and a diaphragm. The magnetic assembly and voice coil cooperatively function as an electromagnetic transducer (also referred to as a driver or motor). The magnetic assembly typically includes a magnet (typically a permanent magnet) and associated ferromagnetic components—such as pole pieces, plates, rings, and the like—arranged with cylindrical or annular symmetry about a central axis. By this configuration, the magnetic assembly establishes a magnetic circuit in which most of the magnetic flux is directed into an annular (circular or ring-shaped) air gap (or "magnetic gap"), with the lines of magnetic flux having a significant radial component relative to the axis of symmetry. The voice coil typically is formed by an electrically conductive wire cylindrically wound for a number of turns around a coil former. The coil former and the attached voice coil are inserted into the air gap of the magnetic assembly such that the voice coil is exposed to the static (fixed-polarity) magnetic field established by the magnetic assembly. The voice coil may be connected to an audio amplifier or other source of electrical signals that are to be converted into sound waves. The diaphragm includes a flexible or compliant material that is responsive to a vibrational input. The diaphragm is suspended by one or more supporting elements of the loudspeaker (e.g., a surround, spider, or the like) such that the flexible portion of the diaphragm is permitted to move. The diaphragm is mechanically referenced to the voice coil, typically by being connected directly to the coil former on which the voice coil is supported.

In operation, electrical signals are transmitted as an alternating current (AC) through the voice coil in a direction substantially perpendicular to the direction of the lines of magnetic flux produced by the magnet. The alternating current produces a dynamic magnetic field, the polarity of which flips in accordance with the alternating waveform of the signals fed through the voice coil. Due to the Lorenz force acting on the coil material positioned in the permanent magnetic field, the alternating current corresponding to electrical signals conveying audio signals actuates the voice coil to reciprocate back and forth in the air gap and, correspondingly, move the diaphragm to which the coil (or coil former) is attached. Accordingly, the reciprocating voice coil actuates the diaphragm to likewise reciprocate and, consequently, produce acoustic signals that propagate as sound waves through a suitable fluid medium such as air. Pressure differences in the fluid medium associated with these waves are interpreted by a listener as sound. The sound waves may be characterized by their instantaneous spectrum and level, and are a function of the characteristics of the electrical signals supplied to the voice coil.

The energy transmitted by a speaker to sound waves is a function of the amount of movement of the diaphragm. The movement of the diaphragm is a function of the frequency of sound being transmitted (how frequently the diaphragm changes directions of movement) and the electrical voltage applied to the coil. The range of movement of the diaphragm is a function of the axial movement of the voice coil. This axial movement is often called the excursion.

For a loudspeaker to provide high output or deep bass, the loudspeaker may need a substantial excursion of the voice coil. In this context, an excursion is an axial movement of the voice coil from the position it assumes without electrical stimulus. Voice coils undergo excursions both towards and away from the diaphragm as the alternating electric current in the voice coil interacts with the magnetic field.

Due to higher power handling, dual-coil/dual magnetic gap designs may result in greater motor excursion. While the use of dual-coil/dual magnetic gap designs is advantageous by providing increased power handling, the use of a dual-coil drive motor design with a pair of coil portions (upper and lower) operating in a pair of magnetic gaps can cause extreme distortion, if the coil excursion becomes too great. More specifically, if the coil excursion is too great the upper coil portion may actually travel down into the magnetic gap for the lower coil portion or the lower coil portion may actually travel up into the magnetic gap for the upper coil portion. Either situation leads to extreme distortion.

The risks of such distortion are increased with the use of a thin magnet such as may be obtained with neodymium magnets as the use of a thin magnet reduces the distance between the upper and lower magnetic gaps and the corresponding spacing between the upper and lower coil portions. A need therefore exists for a dual-coil drive motor design (or other configurations using multiple coil portions) to allow such speakers to be used in applications calling for at least occasional performance of large excursions without extreme distortion.

Further, due to high power dual-coil/dual magnetic gap designs, the dual-coil designs generate a large amount of resistive heat which can cause a loss of efficiency and may damage certain components in the loudspeaker. A need further exists for a dual-coil motor design that not only allows for large excursions without extreme distortion, but that also reduces some of the common problems that occur with the generation of resistive heat within a loudspeaker.

SUMMARY

A dual-coil or multi-coil driver is provided that includes a magnet assembly having a spacer member to effectively axially elongate the permanent magnet. In one example of one implementation, the invention may be implemented as an electromagnetic transducer such as may be employed as electro-acoustical drivers for loudspeakers. The electromechanical driver may be configured to use a combination of a first permanent magnet and a second permanent magnet separated by at least one spacer member containing ferromagnetic material. This stack of two permanent magnets and a spacer may be longer in the axis of oscillation for the electro-acoustical driver than a single permanent magnet of equivalent strength. The elongation from adding the spacer may increase the separation between the first pole piece and the second pole piece and thus increases the distances between the magnetic gaps used to drive the voice coils. Increasing the distances between the magnetic gaps may increase the amount of excursion that a voice coil may undergo without entering into close proximity with a magnetic gap that is intended for use with a different voice coil. Further, by including a spacer between the magnets, the heat generated in the magnet structure is less concentrated, thereby minimizing problems associated with heat generated by the driver and allowing for the generate heat to be more easily dissipated.

Other devices, apparatus, systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention may be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

FIGS. 1-11 describe various implementations of the present subject matter. For purposes of this application, in general, the term "communicate" (for example, a first component "communicates with" or "is in communication with" a second component) is used in the present disclosure to indicate a structural, functional, mechanical, electrical, optical, magnetic, ionic or fluidic relationship between two or more components (or elements, features, or the like). As such, the fact that one component is said to communicate with a second component is not intended to exclude the possibility that additional components may be present between, and/or operatively associated or engaged with, the first and second components.

Figure 1:
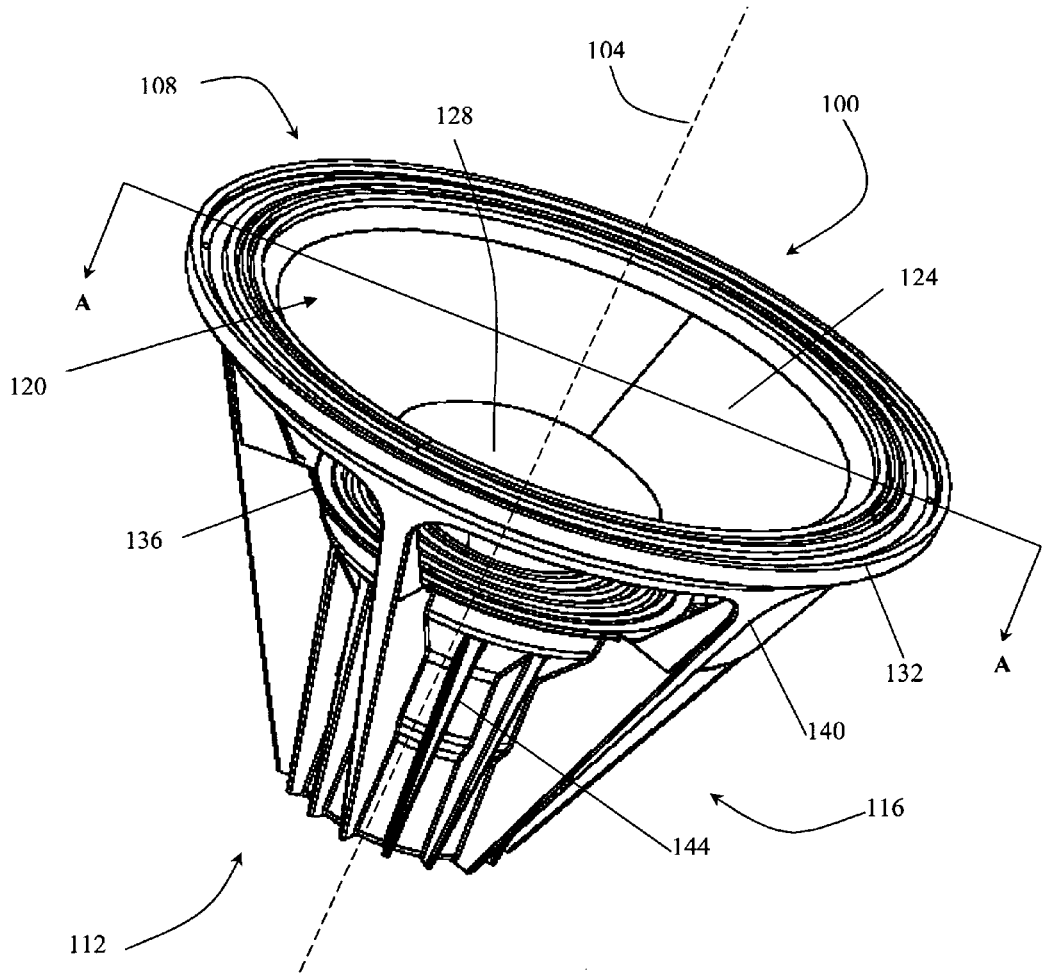
FIG. 1 is a top perspective view of an example of a loudspeaker of the invention.

Turning now to FIG. 1, FIG. 1 is a perspective view of an example of an electro-acoustical transducer in which one or more implementations of the invention may be provided. By way of example, the electro-acoustical transducer may be provided as a loudspeaker 100 or as part of the loudspeaker 100 although in other examples the electro-acoustical transducer is not limited to loudspeaker-type implementations. For purposes of description, the loudspeaker 100 may be considered as being generally arranged or disposed about a central, longitudinal axis 104. It will be understood, however, that the loudspeaker 100 is not limited to being completely symmetrical relative to such central axis 104. Also for purposes of description, the loudspeaker 100 and its components and features generally have a front or upper side 108 and a rear or lower side 112. It will be understood, however, that the use in this disclosure of terms such as "front," "upper," "rear" and "lower" is not intended to limit the loudspeaker 100 or any of its components and features to any particular orientation in space.

The loudspeaker 100 may include a housing 116. The housing 116 may be composed of any suitably stiff, anti-vibrational material such as, for example, a metal (e.g., aluminum, etc.). The utilization of aluminum or other thermally conductive material also enables the housing 116 to serve as a heat sink for the internal heat-generating components of the loudspeaker 100. The outer periphery of the housing 116 is generally swept about the central axis 104, such that the housing 116 may be considered as circumscribing or surrounding an interior space in which various components of the loudspeaker 100 are disposed. A housing 116 of this type may be referred to as a basket. Insofar as the housing 116 may constitute a combination of structural members and openings between structural members, the housing 116 may be considered as at least partially enclosing this interior space. The space external to the housing 116, and more generally external to the loudspeaker 100, will be referred to as the ambient environment. In other implementations, the housing 116 may be continuous so as to completely enclose the interior space in which the components of the loudspeaker 100 are disposed, but openings are considered useful for allowing air to flow to and from the confines of the housing 116 and thus for assisting in cooling the loudspeaker 100.

The loudspeaker 100 may also include a diaphragm 120 that spans the open front end of the housing 116. The diaphragm 120 may be any device that may be attached to or suspended by the housing 116 or other portion of the loudspeaker 100 in a manner that secures the diaphragm 120 while permitting at least a portion of the diaphragm 120 to move axially—i.e., along the direction of the central axis 104—in a reciprocating or oscillating manner. In the present example, the diaphragm 120 includes a generally cone-shaped member 124 (cone) that serves as an axially movable member, and a generally dome-shaped member 128 (dome) that may serve as a dust cover as well as an axially movable member. In other implementations, the movable portion of the diaphragm 120 may have a configuration other than conical, such as a dome or an annular ring. The cone 124 and dome 128 may be constructed from any suitably stiff, well-damped material such as paper. The cone 124 and dome 128 may be provided as a unitary or single-piece construction, or may be attached, connected, or adhered to each other by any suitable means. The cone 124 is attached to the housing 116 through one or more suspension members such as a surround 132 and a spider 136, either or both of which may be annular. The surround 132 and spider 136 may be affixed to the housing 116 by any suitable means. The surround 132 and spider 136 may be any devices that provide a mechanical interconnection between the diaphragm 120 and the housing 116, and allow the diaphragm 120 to move axially relative to the housing 116 while supporting the position of the diaphragm 120 radially relative to the housing 116. For this purpose, the surround 132 and spider 136 may be constructed from flexible, fatigue-resistant materials such as, for example, urethane foam, butyl rubber, phenolic-impregnated cloth, etc. In the illustrated example, the surround 132 and spider 136 have corrugated or "half-roll" profiles to enhance their flexibility and compliance. The surround 132 and spider 136 may be considered with the cone 124 and dome 128 as being parts of the assembly of the diaphragm 120, or may be considered as being components distinct from the diaphragm 120.

In the example illustrated in FIG. 1, the housing 116 generally includes an upper frame portion 140 and a lower frame portion 144. The upper frame portion 140 surrounds the diaphragm 120. The lower frame portion 144 surrounds several internal components of the loudspeaker 100, including an electromagnetic transducer or driver described in detail below.

Figure 2:
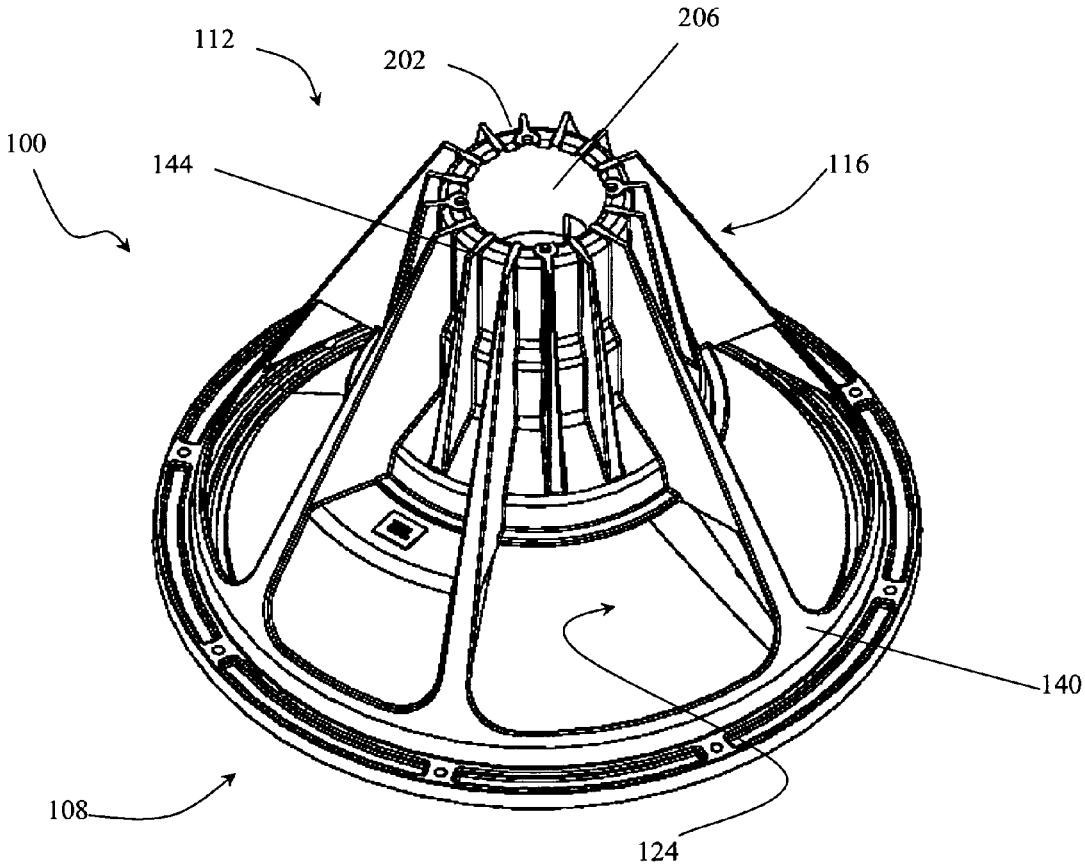
FIG. 2 is a bottom perspective view of the loudspeaker illustrated in FIG. 1.

FIG. 2 is another perspective view of the loudspeaker 100 illustrated in FIG. 1. From this perspective, it may be seen that the lower frame portion 144 is bent or folded inwardly at a rear-most end 202 of the housing 116, and transitions to an inverted cup-shaped end frame portion or pedestal 206. The end frame portion 206 is described further below.

As a general matter, the loudspeaker 100 may be operated in any suitable listening environment such as, for example, the room of a home, a theater, or a large indoor or outdoor arena. Moreover, the loudspeaker 100 may be sized to process any desired range of the audio frequency band, such as the high-frequency range (generally 2 kHz-20 kHz) typically produced by tweeters, the midrange (generally 200 Hz-5 kHz) typically produced by midrange drivers, and the low-frequency range (generally 20 Hz-200 Hz) typically produced by woofers. In the examples provided in this description, the loudspeaker 100 may be considered as being of the direct-radiating type. However, in other alternative examples, the loudspeaker 100 may be considered as being of the compression driver type, the configuration of which is readily appreciated by persons skilled in the art.

Figure 3:
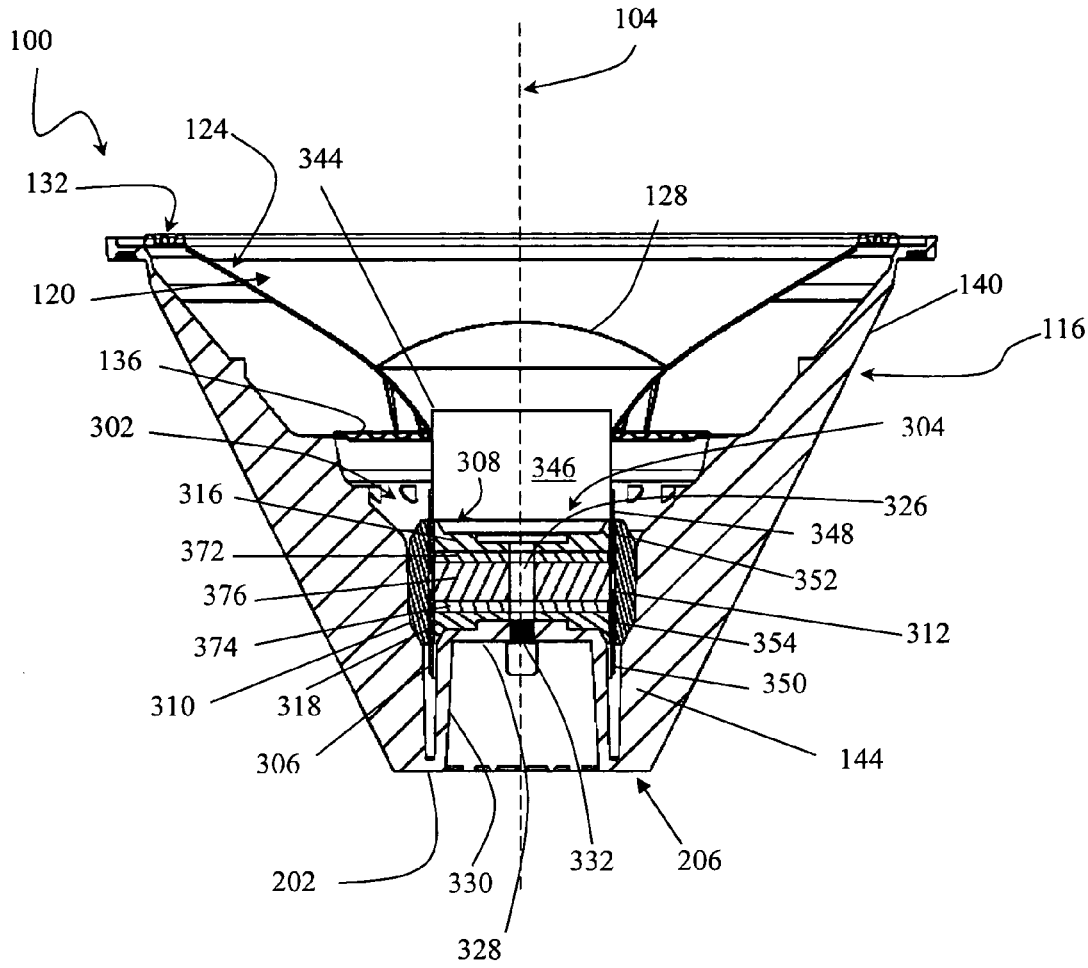
FIG. 3 is a cross-sectional view of the loudspeaker illustrated in FIGS. 1 and 2, taken along line A-A, according to one example of an implementation of the invention.
Figure 4:
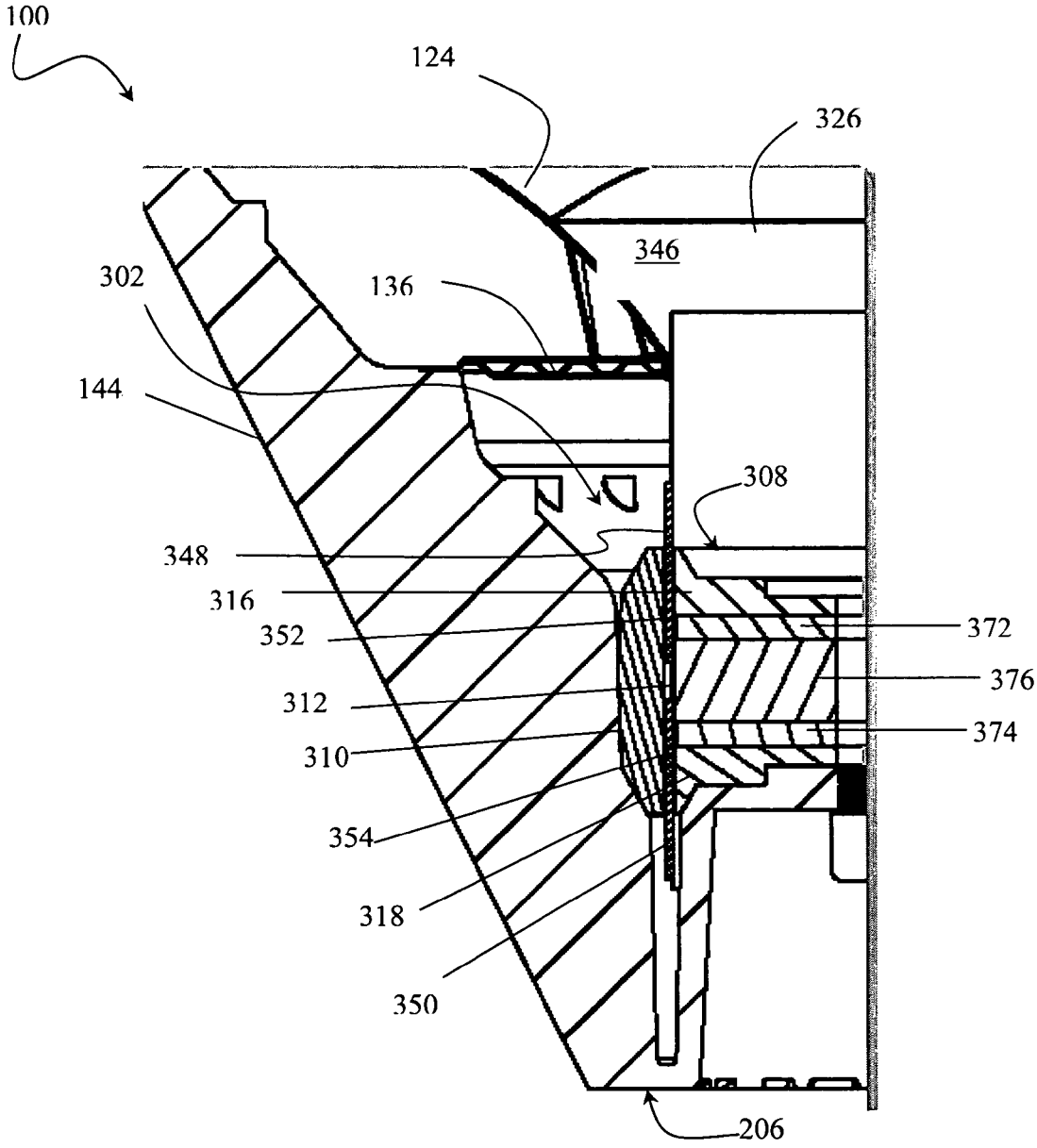
FIG. 4 is a cut away view of a portion of the loudspeaker illustrated in FIG. 3.

FIG. 3 is a cross-sectional view of a loudspeaker 100 that may have an external configuration as illustrated in FIGS. 1 and 2. In FIG. 3, the loudspeaker 100 may be considered as having a "dual-coil drive" or "dual-coil motor" configuration or, more generally, a multiple-coil configuration. As illustrated in FIG. 3, an electromagnetic driver or motor 302 ("driver") is generally disposed in the lower frame portion 144 of the housing 116. The driver 302 includes a magnetic assembly 304 and electrically conductive coils 306 (e.g., voice coils). As best seen in FIG. 4 below, the coil 306 in this dual-coil drive has a pair of coil portions 348 and 350. The magnetic assembly 304 may be any device suitable for providing a permanent magnetic field with which the coil 306 may be electro-dynamically coupled.

In the illustrated example, the magnetic assembly 304 includes an inner magnetic portion 308 and an outer magnetic portion 310 (or gap sleeve). Generally, the terms "inner" and "outer" in this context refer to the radial positions of the two magnetic portions 308 and 310 relative to the central axis 104 and to each other. The outer magnetic portion 310 is generally coaxially disposed about the central axis 104 and may be in the form of a ring or annulus. The outer magnetic portion 310 may be referred to as, or considered as including, a gap sleeve or outer ring. The outer magnetic portion 310 is radially spaced from the inner magnetic portion 308 such that the inner magnetic portion 308 and outer magnetic portion 310 cooperatively define an annular air gap 312 (or magnetic gap) between these two components. In operation, the gap 312 is immersed in the permanent magnetic field established by the magnetic assembly 304.

The inner magnetic portion 308 includes a stacked arrangement of ferromagnetic components that may have any suitable configuration such as plates, disks, or the like. The prior art inner magnet portion consisted of a magnetic element (magnet) interposed between a first (upper or front) pole piece and a second (lower or rear) pole piece. As described in more detail, below, the implementation shown in FIG. 3 utilizes a spacer and a pair of magnets in order to increase the axial dimension of the inner magnet portion.

The magnetic assembly 304 may be secured within the housing 116 by any suitable means. In the example illustrated in FIG. 3, the outer magnetic portion 310 abuts an inside surface of the lower frame portion 144. The lower or rear side of the inner magnetic portion 308 abuts another inside surface of the lower frame portion 144 and the upper or front side of the inner magnetic portion 308 abuts a centrally located support member 326. More specifically in this example, the end frame portion or pedestal 206 of the housing 116 includes a base section 328 and a sidewall section 330 interconnecting the base section 328 at the rear-most end 202. The base section 328 provides the inside surface to which the inner magnetic portion 308 abuts. This configuration provides large areas of surface contact between the outer magnetic portion 310 and the housing 116, and between the inner magnetic portion 308 and the housing 116, thus providing enhanced heat transfer from the magnetic assembly 304 to the housing 116. Moreover, the dimensions of the lower frame portion 144 and end frame portion 206 relative to the coil 306 and magnetic assembly 304, and the contiguous relation between the lower frame portion 144 and the pedestal 206, result in a large, continuous solid mass that may serve well as a heat sink yet is relatively compact in design.

As also illustrated in the example of FIG. 3, the base section 328 has a central bore 332 that is aligned with respective central bores of the components of inner magnetic portion 308. By this configuration, the position of the inner magnetic portion 308 may be fixed by inserting the centrally located support member 326 through the respective central bores of the inner magnetic portion 308 and into the central bore 332 of the base section 328. The centrally located support member 326 may include threads that mate with threads within the central bore 332 of the base section 328, or the centrally located support member 326 may be coupled or attached to the base section 328 by any other suitable means.

While use of a centrally positioned bore is one viable implementation, those of skill in the art will recognize that the inner magnetic portion 308 is fixed in place during use and does not need to rotate around the central bore. Thus, the bore does not need to be centrally located nor does there need to be just one bore. The bore does need to pass through the various components in the inner magnetic portion 308 and may allow for the inner magnetic portion to be fastened to the base section 328. Thus, the component that passes through a bore may be thought of as an alignment rod or as a fastener depending on the implementation and the context. In this context, a rod may have a cross section that is not a circle but may be square or any other shape as long as the shape adequately corresponds to the relevant bore of the inner magnet portion 308.

The coil 306, which may be referred to as a voice coil, may generally be any component that oscillates in response to electrical current while being subjected to the magnetic field established by the magnetic assembly 304. In the illustrated example, the coil 306 is constructed from an elongated conductive element such as a wire that is wound about the central axis 104 in a generally cylindrical or helical manner. The coil 306 is mechanically referenced to, or communicates with, the diaphragm 120 by any suitable means that enables the oscillating coil 306 to consequently actuate or drive the diaphragm 120 in an oscillating manner, thus producing mechanical sound energy correlating to the electrical signals transmitted through the coil 306. In the illustrated example, the coil 306 mechanically communicates with the diaphragm 120 through a coil support structure or member such as a coil former 344. The coil former 344 may be cylindrical as illustrated by example in FIG. 3, and may be composed of a stiff, thermally resistant material such as, for example, a suitable plastic (e.g., polyamide, etc.). The coil former 344 also functions to support the coil 306. The diameter of the coil former 344 is greater than the outside diameter of the inner magnetic portion 308 and less than the inside diameter of the outer magnetic portion 310, enabling the coil former 344 in practice to extend into, and be free to move axially through, the gap 312 between the inner magnetic portion 308 and outer magnetic portion 310.

At least a portion of the coil 306 is wound or wrapped on the outer surface of the coil former 344 and may be securely attached to the coil former 344 such as by an adhesive. The coil 306 may be positioned on the coil former 344 such that at any given time during operation of the loudspeaker 100, at least a portion of the coil 306 is disposed in the gap 312. With this configuration, in operation the coil former 344 oscillates with the coil 306 and the oscillations are translated to the diaphragm 120.

The magnetic assembly 304 is axially spaced from the diaphragm 120. The portion of the interior space of the loudspeaker 100 that generally separates the magnetic assembly 304 from the diaphragm 120 along the axial direction will be referred to as a medial interior region 346. In the present example in which the coil former 344 is connected to the diaphragm 120 in the manner illustrated in FIG. 3, the coil 306 is likewise separated from the diaphragm 120 by the medial interior region 346.

As previously noted, the loudspeaker 100 may be considered as having "dual-coil drive" or "dual-coil motor" configuration. This configuration may be realized in the implementation illustrated in FIG. 3 by forming the coil 306 so as to include a plurality of distinct coil portions (348 and 350 as shown in FIG. 4), such that the coil 306 in effect constitutes a plurality of individual coils. In the implementation illustrated in FIG. 3, the wire of the coil 306 is wound around the coil former 344 for a desired number of turns to form a first (upper or front) coil portion 348, then runs down the side of the coil former 344 for an axial distance, and then is wound around the coil former 344 for a desired number of turns to form a second (lower or rear) coil portion 350 that is axially spaced from the first coil portion 348. The portion of the wire extending between the first coil portion 348 and the second coil portion 350 may be insulated to electrically isolate this portion of the wire from the two coil portions 348 and 350. The two ends of the wire may be connected to any suitable circuitry (including, for example, an amplifier) for driving the loudspeaker 100. The first coil portion 348 and the second coil portion 350 may be positioned on the coil former 344 such that at any given time during operation of the loudspeaker 100, at least a portion of the first coil portion 348 and at least a portion of the second coil portion 350 are disposed in the gap 312. Moreover, the first coil portion 348 may be positioned such that it is generally aligned with (i.e., adjacent to) the first pole piece 316, and the second coil portion 350 may be positioned such that it is generally aligned with (i.e., adjacent to) the second pole piece 318. By this configuration, the gap 312 may be considered as including a first (upper or front) gap 352 (or gap section) in which the first coil portion 348 extends between the first pole piece 316 and the outer magnetic portion 310, and a second (lower or rear) gap 354 (or gap section) in which the second coil portion 350 extends between the second pole piece 318 and the outer magnetic portion 310.

In a case where the first coil portion 348 has the same number of turns (windings) as the second coil portion 350, the number of turns for this dual-coil driver is doubled in comparison to a single-coil configuration having the same number of turns of either individual coil portion 348 or 350. In addition, the surface area covered by the coil 306 having two coil portions 348 and 350 is also doubled. The wire forming the coil 306 may be run in a clockwise direction in one of the coil portions 348 or 350 and in a counterclockwise direction in the other coil portion 350 or 348. By this configuration, the electrical current runs through one of the coil portions 348 or 350 in a direction opposite to the electrical current running through the other coil portion 350 or 348. Because the magnetic flux lines established by the magnetic assembly 304 run in opposite directions in each of the first gap 352 and second gap 354 and the current in each coil portion 348 and 350 runs in opposite directions, Lorenz law holds that the force created by the current in each coil portion 348 and 350 runs in the same direction, thus doubling the force imparted to the coil former 344 and enabling the loudspeaker 100 to generate more power in comparison to a single-coil loudspeaker.

Generally, in operation the loudspeaker 100 receives an input of electrical signals at an appropriate connection to the coil 306, and converts the electrical signals into acoustic signals according to mechanisms briefly summarized above in this disclosure and readily appreciated by persons skilled in the art. The acoustic signals propagate or radiate from the vibrating diaphragm 120 to the ambient environment.

While the specific example illustrated in FIG. 3 provides two coil portions 348 and 350 and two corresponding gaps 352 and 354, it will be understood that other implementations may provide more than two coil portions 348 and 350 and gaps 352 and 354.

Further, the magnets 372 and 374 may be composed of any permanent magnetic material such as, for example, a ceramic, alnico, or a magnetic rare earth metal, particularly neodymium (Nd) or a composition including neodymium such as a composition including neodymium, iron, and boron. In this context, a permanent magnet is a magnet that retains its magnetism after being removed from a magnetic field.

The pole pieces 316 and 318 may be composed of any material capable of carrying magnetic flux such as, for example, steel or cast iron. In some implementations, one or more outer surface sections of the inner magnetic portion 308, such as the outer surfaces of the pole pieces 316 and 318 and the inner surface of the outer magnetic portion 310, may be covered with a sheathing, coating, or plating (not shown) composed of an electrically conductive material such as, for example, copper (Cu), aluminum (Al), or the like. Such sheathing may be employed to reduce distortion and inductance in the loudspeaker 100. In one example, the sheathing has a thickness ranging from about 0.015 to 0.150 inch.

One of ordinary skill in the art will recognize that a spacer member 376 may be constructed from a set of two or more spacers to achieve a desired amount of axial spacing. Allowing a spacer to be made of two or more components may allow the creation of a wide variety of spaces with different axial thicknesses.

As shown in the implementation illustrated FIG. 3, the axial dimension of the spacer member 376 may be greater than that of the individual pole pieces 316 and 318 or that of the individual magnets 372 and 374. The aggregate axial dimension of the spacer member 376 and the two magnets 372 and 374 may be significantly larger than the axial dimension of the equivalent single magnet replaced by the pair of magnets. The aggregate axial dimension may be in the range of double or triple or more of the axial dimension of the equivalent single magnet. In this context an equivalent single magnet is a magnet having a set of properties equivalent to a combination of the two magnets 372 and 374 including being composed of the same material and having the same magnetic characteristics. In summary, those skilled in the art may vary the size and relative size of the magnets 372 and 374 and spacer member 376 depending upon the desired application and may construct the magnets 372 and 374 and spacer member 376 from one or more components.

Further, those skilled in the art will recognize that the spacer member 376 may be designed with different physical properties than those illustrated in the examples presented in this application. For example, the spacer member 376 may be designed with different physical dimensions, may have different magnetic properties and different thermal properties, whether uniform or non-uniform.

The spacer member 376 may be composed of any suitable ferromagnetic material such as, for example, steel, cast iron, sintered ferromagnetic materials or a combination of other materials with steel, cast iron, or sintered ferromagnetic materials. The spacer member 376 may be composed of the same material as the pole pieces 316 and 318, but is not required. The first magnet 372 is interposed between the first pole piece 316 and the spacer member 376, and the second magnet 374 is interposed between the second pole piece 318 and the spacer member 376. As a result, the overall axial dimension of the inner magnetic portion 308 may be greater than dual-coil drivers that lack the spacer member 376 and axially split magnets 372 and 374. Accordingly, the axial dimension of the outer magnetic portion 310 may be increased as needed to accommodate the axially longer drivers 302. One of ordinary skill in the art will recognize that the use of the term split magnets indicates the use of two or more magnets rather than a single permanent magnet. In context, the term split does not require that the split magnets come from the physical act of splitting a magnet into pieces.

Figure 10:
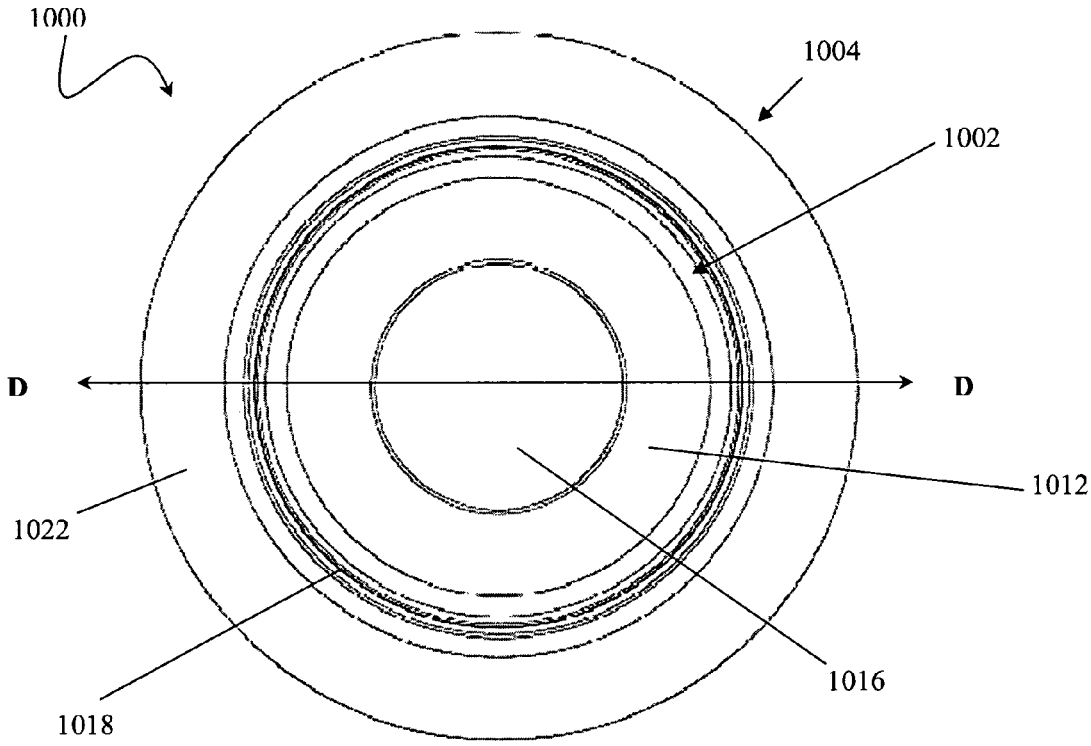
FIG. 10 is a top plan view of a stacked arrangement of components of a magnetic assembly according to another example of an implementation of the invention.
Figure 11:
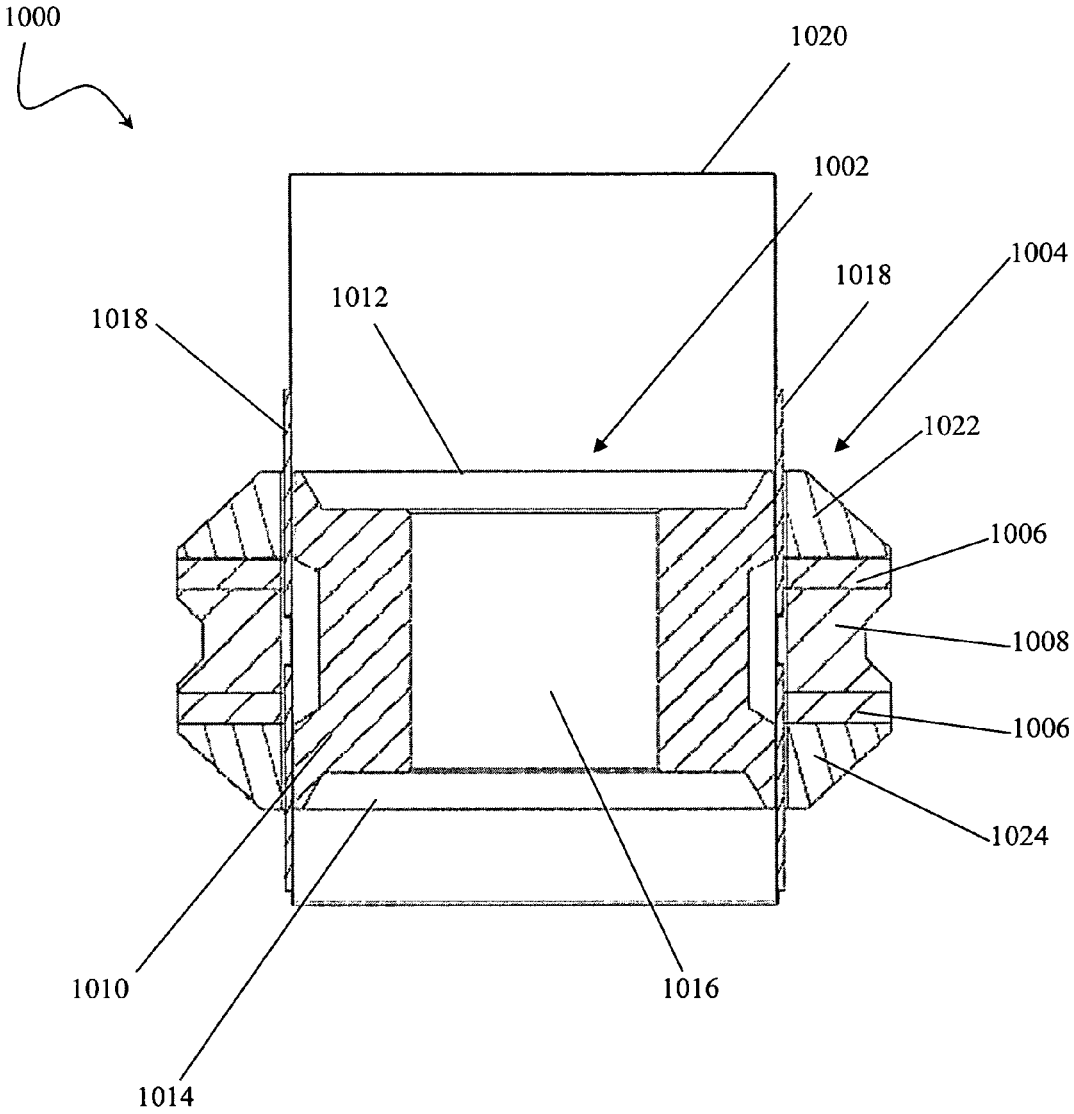
FIG. 11 is a side cross-sectional view of the stacked arrangement illustrated in FIG. 10 taken along line D-D.

Although FIG. 4 illustrates the inner magnetic portion 308 of the magnetic assembly 304 having the spacer member 376 positioned between two magnets 372 and 374, alternately, and as illustrated in FIGS. 10 & 11 below, the outer magnetic portion 310 (or gap sleeve) may be designed to include two magnets and a spacer member 376 to elongate the gap sleeve 310. Having magnets and a spacer member 376 positioned in the gap sleeve 310 may be in addition to, or opposed to, the spacer member 376 in the inner magnetic portion 308 of the magnetic assembly 304.

FIG. 4 is a cut-away view of a portion of the loudspeaker 100 illustrated in FIG. 3. In particular, FIG. 4 illustrates the features of the driver 302 in more detail. It may again be seen that the axial separation of the first and second pole pieces 316 and 318, first and second gaps 352 and 354, and first and second coil portions 348 and 350 increases the axial excursion capability of the driver 302. In the operation of the loudspeaker 100, the increased excursion capability may result in the capacity for increased output, increased bass response, decreased distortion, and a lessening of the risk for damage due to excessive excursion.

Figure 5:
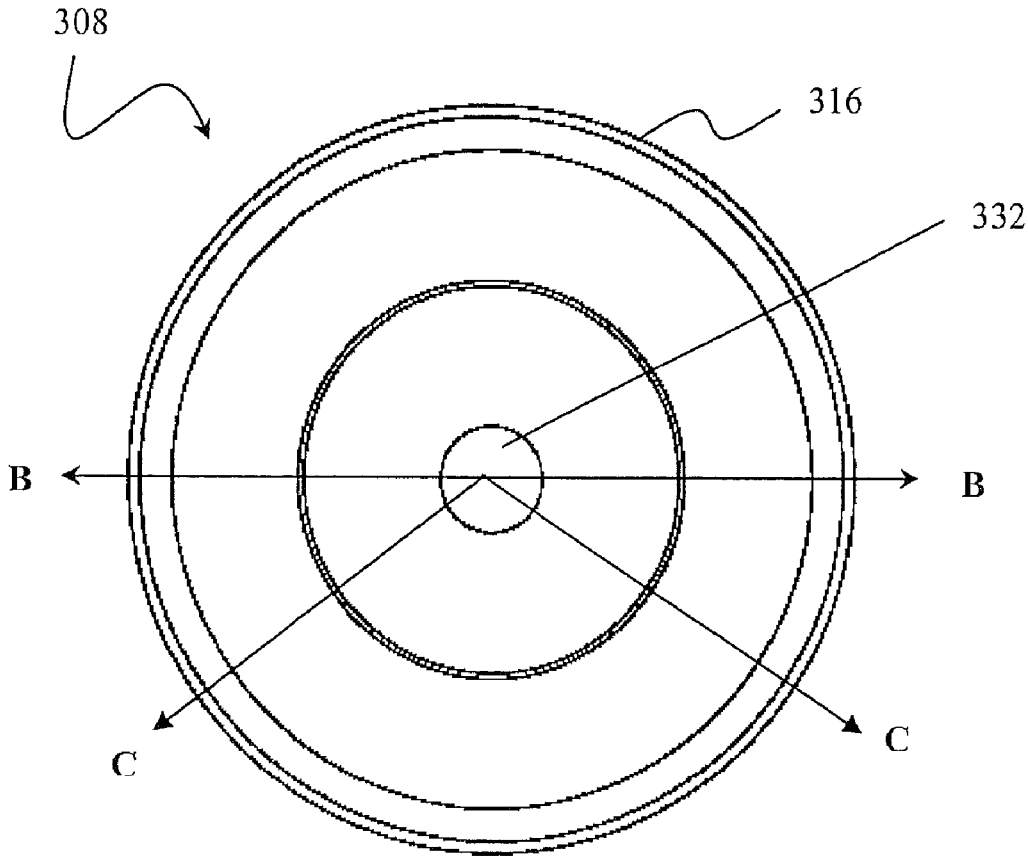
FIG. 5 is a top plan view of a stacked arrangement of components of a magnetic assembly according to an example of an implementation of the invention.

The spacer member 376 illustrated by way of example in FIGS. 4 and 5 has a cylindrical geometry. In other implementations, the spacer member 376 may have other suitable geometries such as, for example, rings such as toroids, necked-down cylinders, and the like. Moreover, the spacer member 376 may have a hollow or solid cross-section. Additionally, the spacer member 376 may include features such as, for example, recesses, cavities, bores, grooves, channels, and the like. Furthermore, the spacer member 376 may provide for the provision of shorting rings and/or flux modulation rings for controlling flux modulation and distortion, as well as phase-change heat absorbers.

While the specific example illustrated in FIGS. 3 and 4 provides two coil portions 348 and 350 and two corresponding gaps 352 and 354, it will be understood that other implementations may provide more than two coil portions 348 and 350 and gaps 352 and 354. It will be also be understood that other implementations may provide more than one spacer member 376 or with more than two magnets 372 and 374.

FIG. 5 is a top plan view of an example of the inner magnetic portion 308 of the implementation illustrated in FIGS. 3 and 4. From this view, the first pole piece 316 is visible along with the central bore 332 that is aligned with respective central bores of the components of inner magnetic portion 308.

Figure 6:
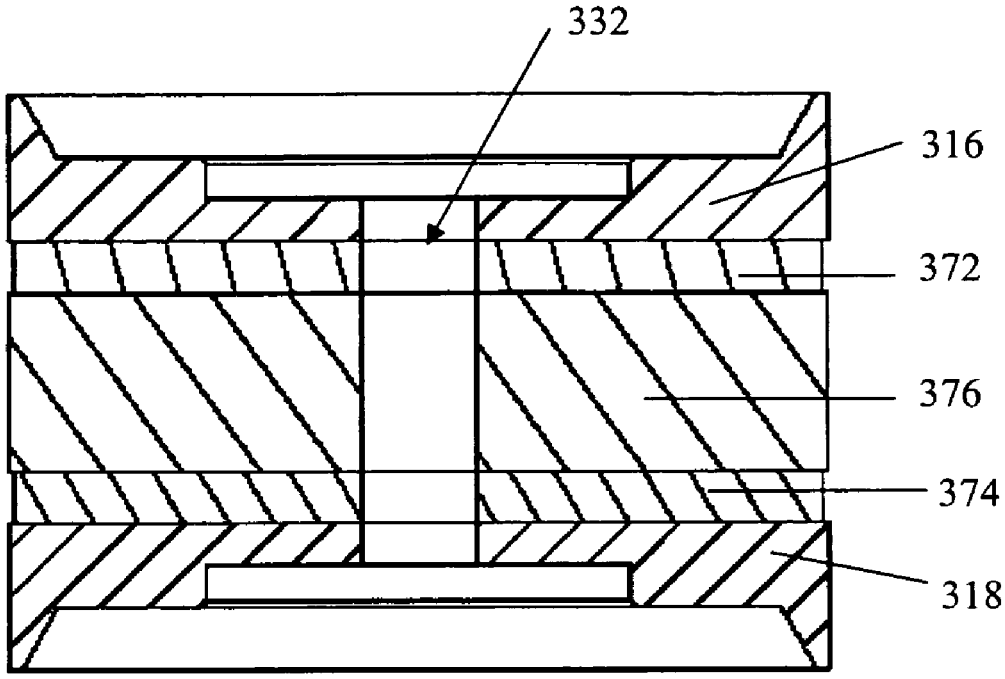
FIG. 6 is a side cross-sectional view of the stacked arrangement illustrated in FIG. 5 taken along line B-B.

FIG. 6 is a cross section view of the inner magnetic portion 308 illustrated in FIG. 5 taken along line B-B. First pole piece 316 visible in FIG. 5 is adjacent to first magnet 372 that is adjacent to spacer member 376. Spacer member 376 is adjacent to second magnet 374 that is adjacent to second pole piece 318. A central bore portion 332 extends through the middle portion of the inner magnetic portion 308.

Figure 7:
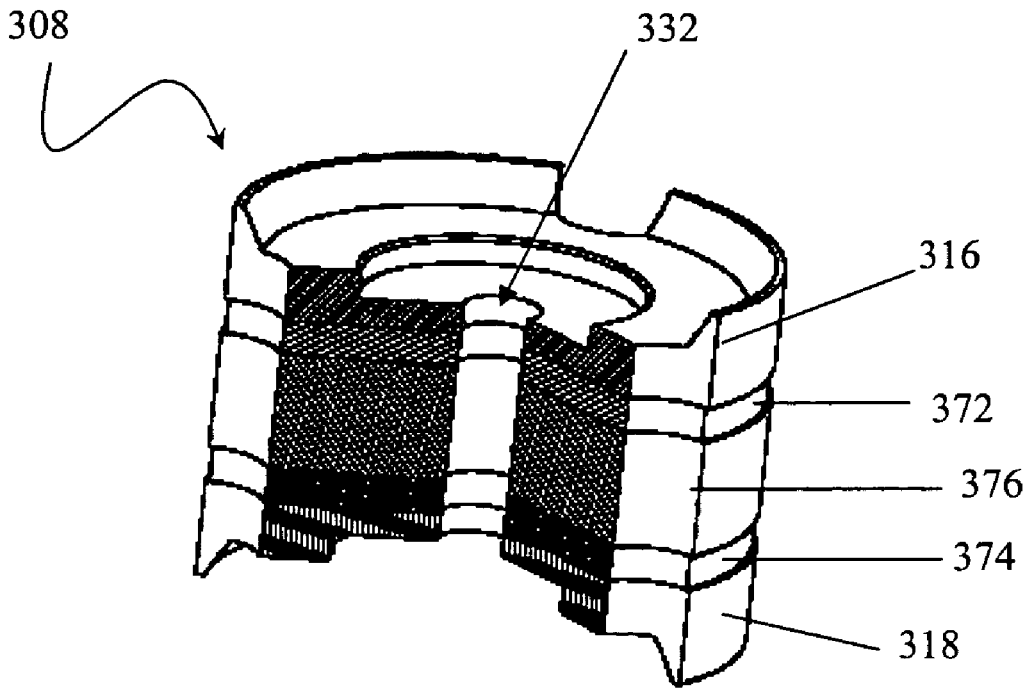
FIG. 7 is a perspective cross-sectional view of the stacked arrangement illustrated in FIG. 5 taken alone line C-C.

FIG. 7 is a perspective cross section view of the inner magnetic portion 308 illustrated in FIG. 5 taken along line C-C. Like FIG. 5, the first pole piece 316 is adjacent to first magnet 372 that is adjacent to spacer member 376. Spacer member 376 is adjacent to second magnet 374 that is adjacent to second pole piece 318. The central bore portion 332 is also visible in FIG. 7.

Figure 8:
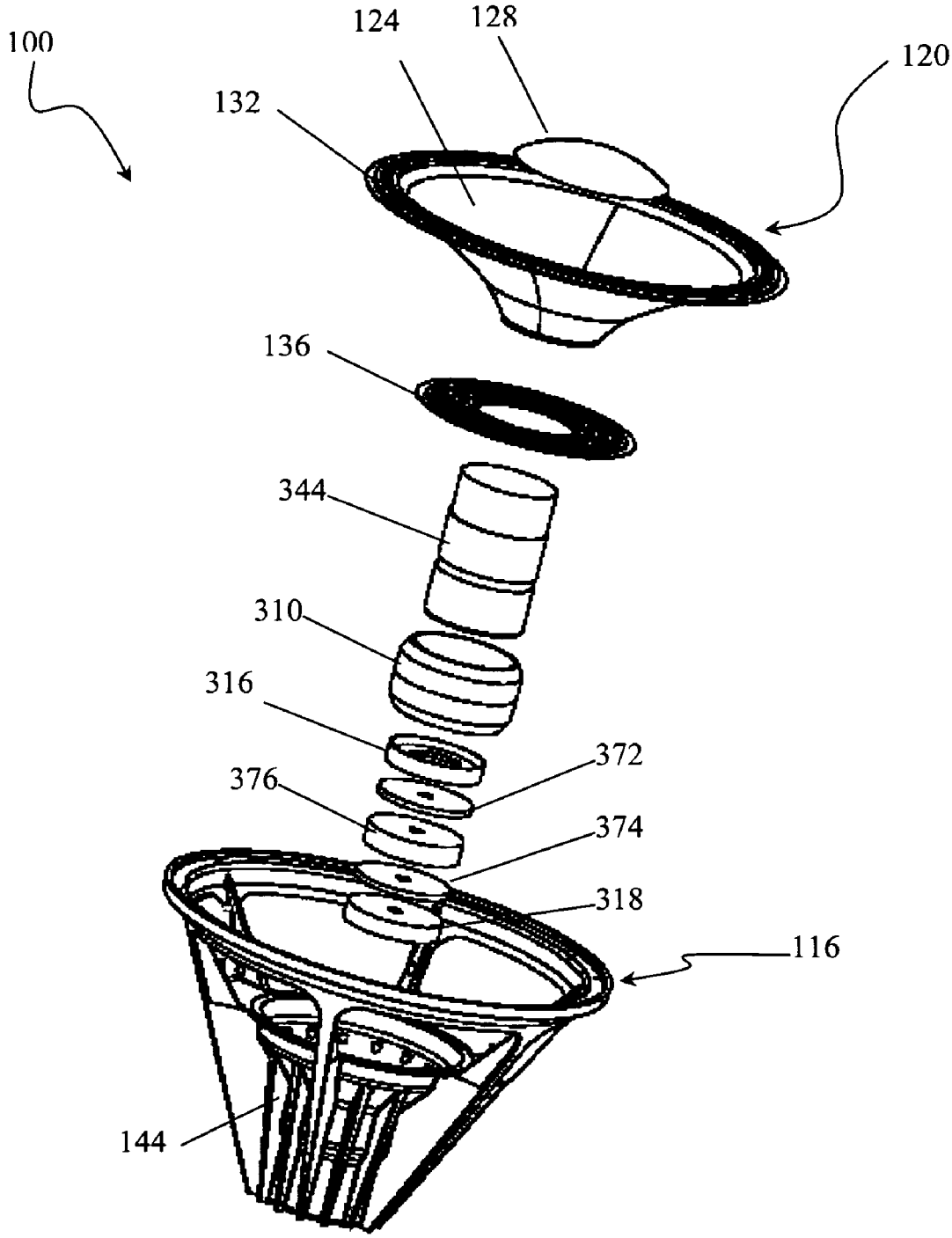
FIG. 8 is a perspective, exploded view illustrating various components of the loudspeaker illustrated in FIG. 1, according to the example of the implementation illustrated in FIG. 3.

FIG. 8 is a perspective, exploded view illustrating various components of the loudspeaker 100 illustrated in FIGS. 1-7 prior to assembly. Moving from the top of the drawing downward, the following components are identified: dome 128, surround 132, cone 124, spider 136, coil former 344, outer magnetic portion 310, first pole piece 316, first magnet 372, spacer member 376, second magnet 374, second pole piece 318, and housing 116. To avoid undue clutter, the centrally located support member 326 is not shown in this view.

Although not shown, the loudspeaker 100 may be mounted by any suitable means to a structure such as a baffle plate, cabinet, wall, or the like. The structure may have an opening sized to receive the loudspeaker 100. As appreciated by persons skilled in the art, the structure may include additional openings for mounting other loudspeakers, for outputting acoustic waves of the same frequency range as or different frequency ranges from the loudspeaker 100 described above.

It may thus be seen that implementations provided in this disclosure may be useful in increasing the axial spacing of the magnetic gaps so that there is a greater tolerance of the dual-coil motor to excursions without the risk of distortion arising from a coil being driven out of its magnetic gap and into the magnetic gap of another coil (sometimes called a coil portion).

The increased spacing of the coils may assist in the cooling of the two or more coils, magnets, and associated structures of an electromagnetic transducer such as the type utilized in or constituting a loudspeaker or other type of electro-acoustical transducer.

Figure 9:
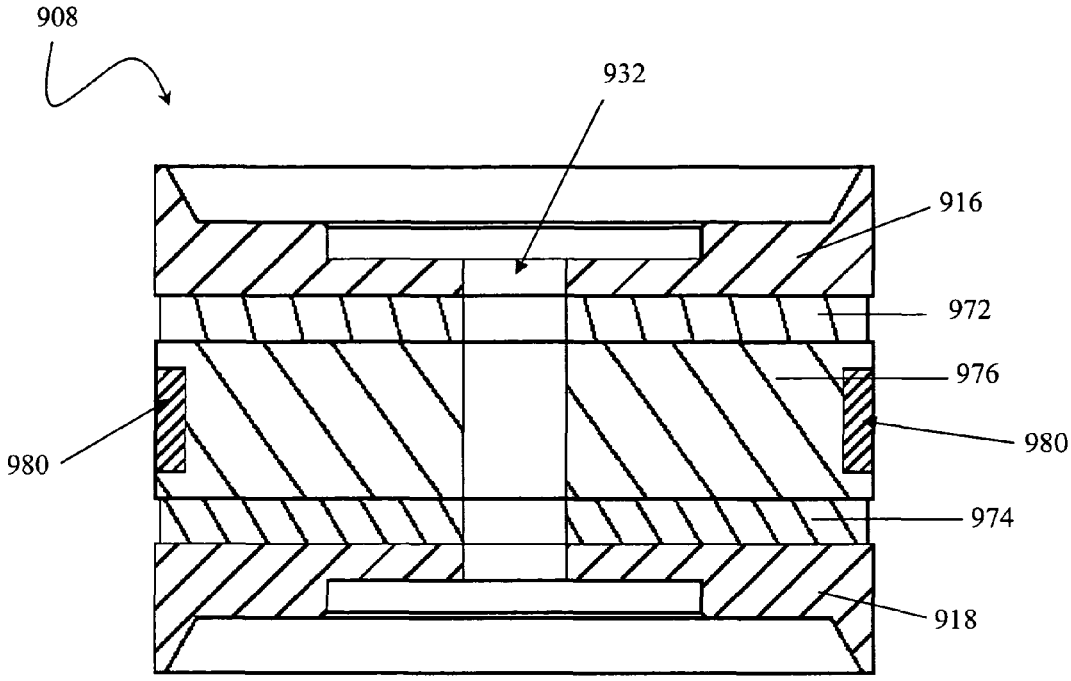
FIG. 9 is a cross-sectional view of an example of an electromagnetic driver or motor according to another implementation.

FIG. 9 is a cross-sectional view of an example of an inner magnetic portion 908 of an electromagnetic driver or motor according to another implementation. In the example illustrated in FIG. 9, electrically conductive shorting rings 980 may be employed instead of sheathing to reduce distortion and inductance. The shorting rings may be composed of any suitable material (e.g., copper, aluminum, or the like), and may have thicknesses ranging from about 0.05 to 1 inch and axial lengths as much as the full length of the spacer.

As shown in FIG. 9, in this alternative embodiment, the inner magnetic portion 908 of an electromagnetic driver or motor includes a first upper pole piece 916, a second lower pole piece 918, first upper magnet 972, second lower magnet 974 and a spacer member 976. Shorting rings 980 are disposed about the exterior of the spacer member 976. Also shown in FIG. 9 is a central bore 932 that is aligned with respective central bores of the components of the inner magnetic portion 908.

FIG. 10 is a top plan view of a stacked arrangement of components of a magnetic assembly 1000 according to another example of an implementation of the invention. From this view, the magnetic assembly 1000, including an inner magnetic portion 1002 and outer magnetic portion 1004 (or gap sleeve), may be seen. The first pole piece 1012 along with the central bore of inner magnetic portion 1002 and the first pole piece 1022 of the outer magnetic portion 1004 are illustrated. The coil 1018 is positioned in the gap between the inner magnetic portion 1002 and the outer magnetic portion 1004.

FIG. 11 is a side cross-sectional view of the stacked arrangement illustrated in FIG. 10 taken along line D-D. In this example, the magnetic assembly 1000 includes an inner magnetic portion 1002 and an outer magnetic portion 1004 (or gap sleeve). The magnetic assembly in FIGS. 10 & 11 is similar to the magnetic assemblies illustrated in FIGS. 1-9 except that the outer magnetic portion 1004, rather than the inner magnetic portion 1002, utilizes a pair of magnets 1006 separated by a spacer 1008. The inner magnetic portion 1002 consists of a magnetic element (dual pole piece) 1010 which fowls both a first (upper or front) pole 1012 and a second (lower or rear) pole 1014. The inner magnetic portion 1002 may abut a centrally located support member 1016. The inner magnetic portion 1002 is shown as a single piece in this embodiment, but it may consist of multiple parts to provide distortion reduction, motor cooling, ease of assembly, or other functions as in the previous embodiments.

An electrically conductive coil 1018 is positioned within the air gap between the inner magnetic portion 1002 and the outer magnetic portion 1004. As previously described, the coil 1018, which may be referred to as a voice coil, may generally be any component that oscillates in response to electrical current while being subjected to the magnetic field established by the magnetic assembly 1000. In the illustrated example, the coil 1018 is constructed from an elongated conductive element such as a wire that is wound about the central axis in a generally cylindrical or helical manner. The coil 1018 is mechanically referenced to, or communicates with, the diaphragm 120 (FIG. 1) by any suitable means that enables the oscillating coil 1018 to consequently actuate or drive the diaphragm 120 (FIG. 1) in an oscillating manner, thus producing mechanical sound energy correlating to the electrical signals transmitted through the coil 1018. In the illustrated example, the coil 1018 mechanically communicates with the diaphragm 120 (See FIG. 1) through a coil support structure or member such as a coil former 1020. As with the previously described embodiments, the coil 1018 may include a plurality of distinct coil portions, such that the coil 1018 constitutes a plurality of individual coils.

As illustrated in FIG. 11, the outer magnetic portion 1004 of the magnetic assembly 1000 has a spacer member 1008 positioned between two magnets 1006. Having magnets 1006 and a spacer member 1008 positioned in the outer magnetic portion or gap sleeve 1004 may be in addition to, or opposed to, the spacer member 376 (FIG. 4) in the inner magnetic portion 308 (FIG. 4) of the magnetic assembly 304 (FIG. 4). The two magnets 1006 and spacer member 1008 are interposed between a first (upper or front) pole piece 1022 and a second (lower or rear) pole piece 1024. The several pieces constituting the outer magnetic portion 1004 may be held together by a variety of means including but not limited to: adhesive between the various parts, adhesive between the various parts and the supporting speaker frame, press fit of the parts into the supporting speaker frame, mechanical fasteners positioned axially through the stack, mechanical fasteners between the parts and the speaker frame, retaining rings, clamps, or other suitable methods providing secure location of the parts in the overall assembly.

As previously discussed, the magnets 1006 may be composed of any permanent magnetic material such as, for example, a ceramic, alnico, or a magnetic rare earth metal, particularly neodymium (Nd) or a composition including neodymium such as a composition including neodymium, iron, and boron. The spacer member 1008 may be composed of any suitable ferromagnetic material such as, for example, steel, cast iron, sintered ferromagnetic materials or a combination of other materials with steel, cast iron, or sintered ferromagnetic materials. Further, the pole pieces 1022 and 1024 may be composed of any material capable of carrying magnetic flux such as, for example, steel or cast iron.

The spacer member 1008 may be constructed from a single spacer or a set of two or more spacers 1008 to achieve a desired amount of axial spacing. Allowing a spacer to be made of two or more components may allow the creation of a wide variety of spacers with different axial thicknesses.

Further, the axial dimension of the spacer member 1008 may be greater than that of the individual pole pieces 1022 and 1024 or that of the individual magnets 1006. The aggregate axial dimension of the spacer member 1008 and the two magnets 1006 may be significantly larger than the axial dimension of the equivalent single magnet replaced by the pair of magnets 1006. In summary, those skilled in the art may vary the size and relative size of the magnets 1006 and the spacer member 1008 depending upon the desired application and may construct the magnets 1006 and spacer member 1008 from one or more components, and may vary the physical dimensions, magnetic properties and thermal properties, whether uniform or non-uniform, of the spacer member 1008.

The foregoing description of implementations has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

What is claimed is:

1. An electromagnetic driver for use in an electromagnetic transducer, the electromagnetic driver comprising:

an inner magnetic portion held in fixed relationship to an outer magnetic portion so as to form an air gap between the inner magnetic portion and the outer magnetic portion, where the inner magnetic portion is not in physical contact with the outer magnetic portion, the inner magnetic portion including:

a ferromagnetic spacer member including a first side, an axially opposite second side, and an axial thickness between the first side and the second side, where the spacer member is ferromagnetic throughout the axial thickness;

a first permanent magnet in contact with the first side;

a second permanent magnet in contact with the second side;

a first pole piece capable of carrying magnetic flux; and a second pole piece capable of carrying magnetic flux, where the first permanent magnet, the spacer member, and the second permanent magnet are located between the first pole piece and the second pole piece; and a coil former, where a portion of the coil former is located within the air gap and capable of a range of axial movement within the air gap, the coil former having a first coil portion and a second coil portion, the coil former with the first coil portion and the second coil portion being adapted to oscillate in response to changes in electric current applied to the first coil portion and the second coil portion while subjected to a magnetic field in the air gap.

2. The electromagnetic driver of claim 1 where the inner magnetic portion includes a stack of components including the first pole piece, the first permanent magnet, the spacer member, the second permanent magnet and the second pole piece, the stack of components being arranged so that an alignment rod may be passed through an inner magnetic portion bore that includes a set of substantially aligned bores in the components in the stack of components.

3. The electromagnetic driver of claim 1 where the spacer member is of a cylindrical shape.

4. The electromagnetic driver of claim 3 where the spacer member has at least one bore for use with an alignment rod.

5. The electromagnetic driver of claim 1 where the spacer member is a toroid.

6. The electromagnetic driver of claim 1 where the axial thickness of the spacer member is more than an axial thickness of the first permanent magnet.

7. An electromagnetic driver for use in an electromagnetic transducer, the electromagnetic driver comprising:

an inner magnetic portion held in fixed relationship to an outer magnetic portion so as to form an air gap between the inner magnetic portion and the outer magnetic portion, where the inner magnetic portion is not in physical contact with the outer magnetic portion, the outer magnetic portion including:

a spacer member;

a first permanent magnet;

a second permanent magnet;

a first pole piece capable of carrying magnetic flux;

a second pole piece capable of carrying magnetic flux, the first spacer member located between the first permanent magnet and the second permanent magnet, the first permanent magnet, the first spacer member, and the second permanent magnet located between the first pole piece and the second pole piece; and a coil former, a portion of the coil former located within the air gap and capable of a range of movement within the air gap along a first axis, the coil former having a first coil portion and a second coil portion, the coil former with the first coil portion and the second coil portion being adapted to oscillate in response to changes in electric current applied to the first coil portion and the second coil portion while subject to a magnetic field in the air gap.

8. The electromagnetic driver of claim 7 where the spacer member is a toroid.

9. The electromagnetic driver of claim 7 where the thickness of the spacer member as measured along the first axis is more than the thickness of the first permanent magnet.

10. A loudspeaker driver structure for driving a vibratable diaphragm to produce sound comprising:

a first magnetic gap between an inner magnetic portion aligned along a central axis and an outer magnetic portion aligned along the central axis, where the inner magnetic portion is not in physical contact with the outer magnetic portion, the first magnetic gap in proximity to a first pole piece on the inner magnetic portion;

a second magnetic gap between the inner magnetic portion and the outer magnetic portion, the second magnetic gap in proximity to a second pole piece on the inner magnetic portion;

the first pole piece separated from the second pole piece in the inner magnetic portion by a component stack including a first permanent magnet, a second permanent magnet, and a ferromagnetic spacer member including a first side, an opposite second side, and an axial thickness measured along the central axis between the first side and the second side, where the ferromagnetic spacer member is ferromagnetic throughout the axial thickness, and where the first permanent magnet is in contact with the first side, and the second permanent magnet is in contact with the second side; and a first coil portion and a second coil portion located spaced apart on a coil former as part of a voice coil assembly that is disposed about the central axis, drivingly coupled to the diaphragm and adapted for oscillation in a direction parallel to the central axis in response to electric current applied to the first coil portion and the second coil portion while subjected to a magnetic field.

11. The loudspeaker driver structure of claim 10 where the inner magnetic portion is a stack of magnetic components including the first pole piece, the first permanent magnet, the ferromagnetic spacer member, the second permanent magnet and the second pole piece, the stack of magnetic components being arranged so that an alignment rod may be passed through an inner magnetic portion bore that includes a set of substantially aligned bores in the components in the stack of components.

12. The loudspeaker driver of claim 10 where the ferromagnetic spacer member is of a cylindrical shape.

13. The loudspeaker driver of claim 10 where the ferromagnetic spacer member has at least one bore for use with an alignment rod.

14. The loudspeaker driver of claim 10 where the ferromagnetic spacer member is a toroid.

15. The loudspeaker driver of claim 10 where the axial thickness of the ferromagnetic spacer member as measured along the central axis is more than an axial thickness of the first permanent magnet.

16. A loudspeaker driver structure for driving a vibratable diaphragm to produce sound comprising:

a first magnetic gap between an inner magnetic portion aligned along a central axis and an outer magnetic portion aligned along the central axis, where the inner magnetic portion is not in physical contact with the outer magnetic portion, and where the first magnetic gap is in proximity to a first pole piece on the inner magnetic portion;

a second magnetic gap between the inner magnetic portion and the outer magnetic portion, the second magnetic gap in proximity to a second pole piece on the inner magnetic portion;

the first pole piece separated from the second pole piece in the outer magnetic portion by a component stack including a first permanent magnet, a second permanent magnet, a spacer member located between the first permanent magnet and the second permanent magnet; and a first coil portion and a second coil portion located spaced apart on a coil former as part of a voice coil assembly that is disposed about the central axis, drivingly coupled to the diaphragm and adapted for oscillation in a direction parallel to the central axis in response to electric current applied to the first coil portion and the second coil portion while subjected to a magnetic field.

17. The loudspeaker driver of claim 16 where the spacer member is a toroid.

18. The loudspeaker driver of claim 16 where the thickness of the spacer member as measured along the central axis is more than the thickness of the first permanent magnet.

19. The electromagnetic driver of claim 1, where the inner magnetic portion further includes an electrically conductive shorting ring disposed about a portion of an outer surface of the spacer member.

20. The electromagnetic driver of claim 1 where an outer surface of the first pole piece includes a coating of electrically conductive material.

21. The electromagnetic driver of claim 1 where an outer surface of the second pole piece includes a coating of electrically conductive material.

22. The loudspeaker driver structure of claim 10 further comprising an electrically conductive shorting ring disposed about a portion of a surface of the ferromagnetic spacer member.

23. The loudspeaker driver structure of claim 10 where an outer surface of the first pole piece includes a coating of electrically conductive material.

24. The loudspeaker driver structure of claim 10 where an outer surface of the second pole piece includes a coating of electrically conductive material.

* * * * *